US012319392B2

(12) United States Patent
Maasen et al.

(10) Patent No.: US 12,319,392 B2
(45) Date of Patent: Jun. 3, 2025

(54) SHIFTABLE BOAT LIFT

(71) Applicants: Mark Maasen, Camdenton, MO (US); Michael Maasen, Gravois Mills, MO (US)

(72) Inventors: Mark Maasen, Camdenton, MO (US); Michael Maasen, Gravois Mills, MO (US)

( * ) Notice: Subject to any disclaimer, the term of this patent is extended or adjusted under 35 U.S.C. 154(b) by 537 days.

(21) Appl. No.: 17/723,735

(22) Filed: Apr. 19, 2022

(65) Prior Publication Data

US 2023/0331359 A1 Oct. 19, 2023

(51) Int. Cl.
*B63C 1/06* (2006.01)

(52) U.S. Cl.
CPC ..... *B63C 1/06* (2013.01)

(58) Field of Classification Search
CPC .... B63C 1/02; B63C 1/04; B63C 1/06; B63C 3/06; B63C 3/08; B63C 3/12
See application file for complete search history.

(56) References Cited

U.S. PATENT DOCUMENTS

| | | | | |
|---|---|---|---|---|
| 4,072,119 | A * | 2/1978 | Williams | B63C 3/06 114/45 |
| 2011/0243663 | A1* | 10/2011 | Smith | B63C 3/02 405/3 |
| 2015/0197322 | A1* | 7/2015 | Doig | B63C 3/08 405/2 |
| 2020/0298948 | A1* | 9/2020 | Peterson | B63C 3/12 |

* cited by examiner

*Primary Examiner* — Andrew Polay
(74) *Attorney, Agent, or Firm* — Hovey Williams LLP

(57) ABSTRACT

A boat lift assembly is configured to support a boat adjacent a dock and permit relative horizontal shifting of the supported boat into and out of a berth defined at least partly by the dock. The boat lift assembly includes a boat lift, an elongated carriage track, and a shiftable carriage. The boat lift includes a vertically-shiftable platform to support and position the boat. The carriage track is configured to be attached relative to the dock and extend horizontally along the length of the berth. The shiftable carriage is operably attached to the boat lift. The carriage is slidably supported at least in part by the carriage track to slide along the length thereof and shift the boat lift and boat horizontally relative to the berth.

23 Claims, 12 Drawing Sheets

SHIFTABLE BOAT LIFT

BACKGROUND OF THE INVENTION

Field of the Invention

The present invention is generally directed toward boat lifts operably associated with a boat slip. In certain embodiments, a boat lift may be positioned relative to the boat slip by a shiftable carriage.

DESCRIPTION OF THE PRIOR ART

Conventional boat lifts have long been used for storing small watercraft adjacent to or alongside piers, docks, and slips. Prior art floating boat lifts are known to include a platform to receive the boat and one or more adjustable-buoyancy pontoons for raising and lowering the platform relative to the water level. In many well-known applications, a boat lift is bounded on three sides by a dock that defines a boat slip. When a boat is stored in such a boat slip, the dock provides user access to the boat from both sides.

However, known boat lifts and docks have various deficiencies. For instance, conventional three-sided docks provide limited storage space for boats. Larger vessels may extend out of the slip when in storage. Furthermore, larger vessels may be difficult to berth in the slip without causing inadvertent contact between the boat and the dock.

This background discussion is intended to provide information related to the present invention which is not necessarily prior art.

SUMMARY OF THE INVENTION

The following brief summary is provided to indicate the nature of the subject matter disclosed herein. While certain aspects of the present invention are described below, the summary is not intended to limit the scope of the present invention.

Embodiments of the present invention provide a boat lift assembly that does not suffer from the problems and limitations of prior art boat lift devices, including those set forth above.

According to one embodiment of the present invention there is provided a boat lift assembly configured to support a boat adjacent a dock and permit relative horizontal shifting of the supported boat into and out of a berth defined at least partly by the dock. The boat lift assembly broadly includes a boat lift, an elongated carriage track, and a shiftable carriage. The boat lift includes a vertically-shiftable platform to support and position the boat. The carriage track is configured to be attached relative to the dock and extend horizontally along the length of the berth. The shiftable carriage is operably attached to the boat lift. The carriage is slidably supported at least in part by the carriage track to slide along the length thereof and shift the boat lift and boat horizontally relative to the berth.

According to another embodiment of the present invention, a boat lift kit is operable to be installed as part of a boat lift assembly that is configured to support a boat adjacent a dock and permit relative horizontal shifting of the supported boat into and out of a berth defined at least partly by the dock. The boat lift assembly includes a boat lift with a vertically-shiftable platform to support and position the boat. The boat lift kit broadly includes an elongated carriage track and a shiftable carriage. The carriage track is configured to be attached relative to the dock and extend horizontally along the length of the berth. The carriage is configured to be operably attached to the boat lift. The carriage is slidably supported at least in part by the carriage track to slide along the length thereof and shift the boat lift and boat horizontally relative to the berth. The carriage includes a plurality of beam trolleys slidably supported on the carriage track, with the beam trolleys cooperatively guiding the boat lift as the carriage slides along the length of the carriage track.

According to still another embodiment of the present invention, there is provided a method of retrofitting a boat lift with a carriage assembly that permits relative horizontal shifting of a supported boat into and out of a berth defined at least partly by a dock. The method broadly includes the steps of attaching an elongated carriage track of the carriage assembly relative to the dock, with the carriage track extending horizontally along the length of the berth; attaching a carriage of the carriage assembly to the boat lift; and shiftably mounting the carriage to the carriage track so that the carriage assembly may be operated to guide the boat lift along the length of the carriage track.

Figure 1:
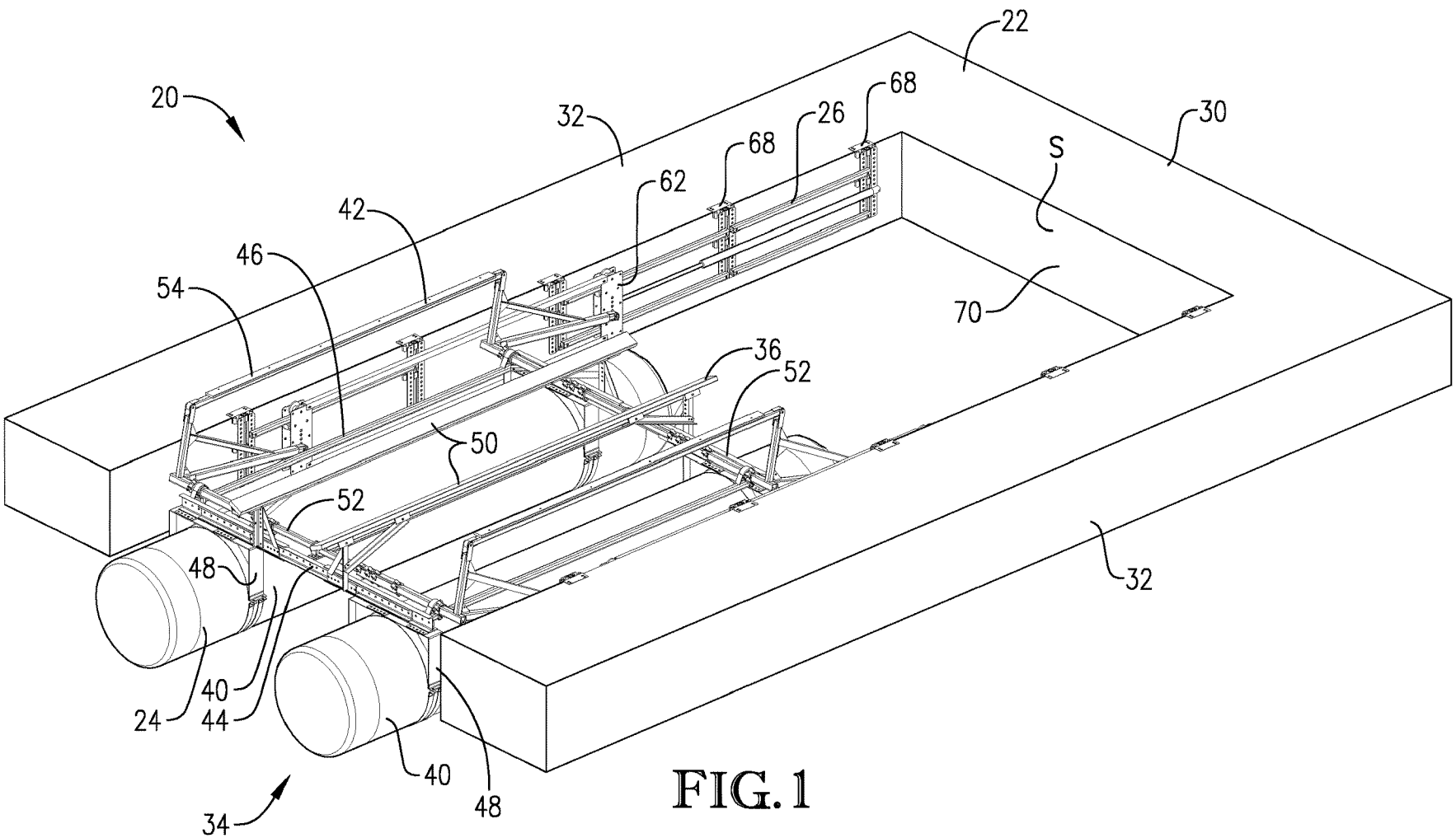
FIG. 1 is an upper perspective view of a boat lift assembly according to one embodiment of the present invention and depicting the boat lift assembly in use with a floating dock, showing the boat lift assembly in an extended position.
Figure 2:
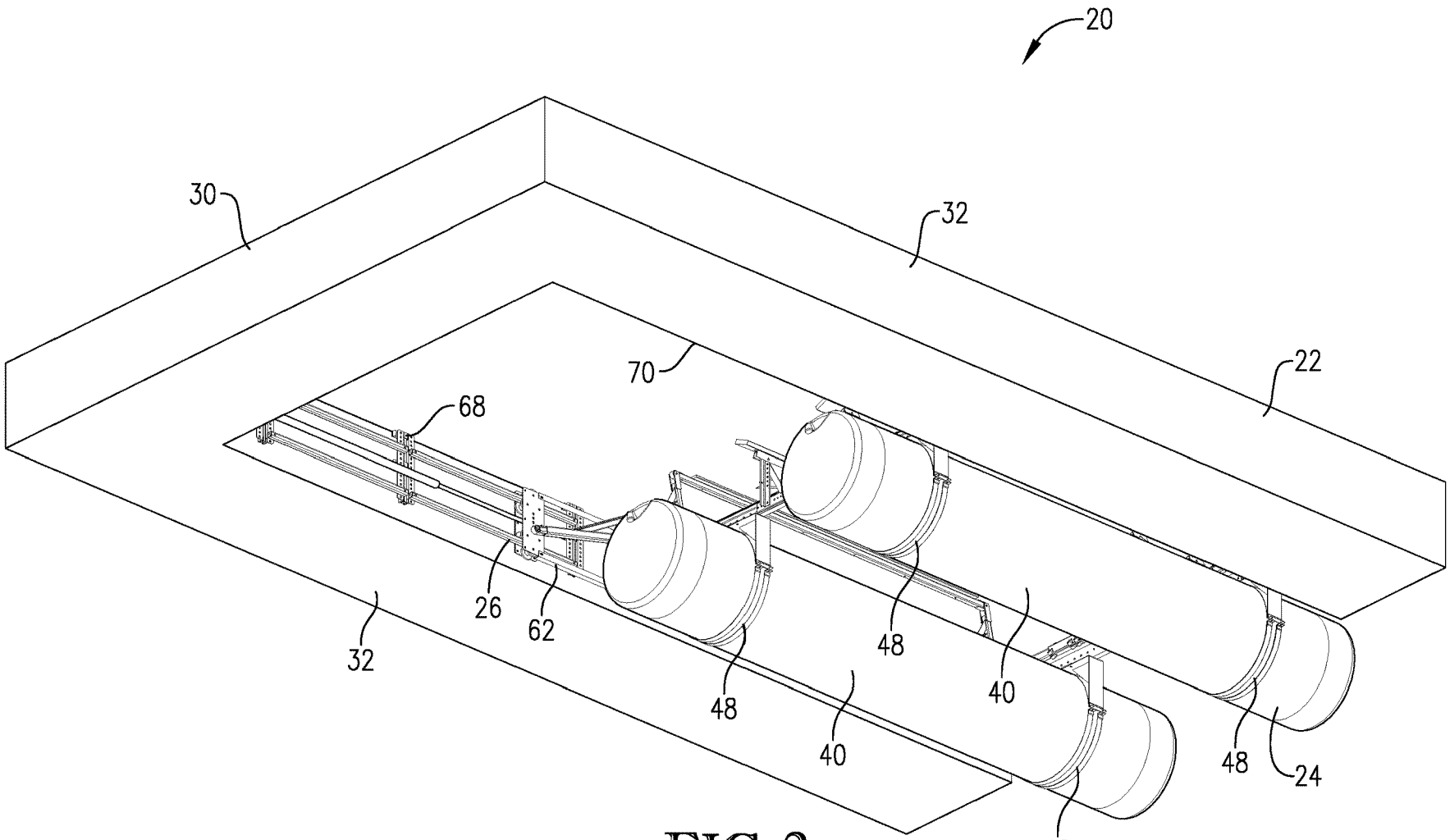
FIG. 2 is a lower perspective view of the boat lift assembly and floating dock shown in FIG. 1, with the boat lift assembly including a boat lift and a carriage assembly, and with the carriage assembly including elongated carriage tracks attached to the floating dock, and shiftable carriages slidably mounted on respective carriage tracks and attached to the boat lift.
Figure 3A:
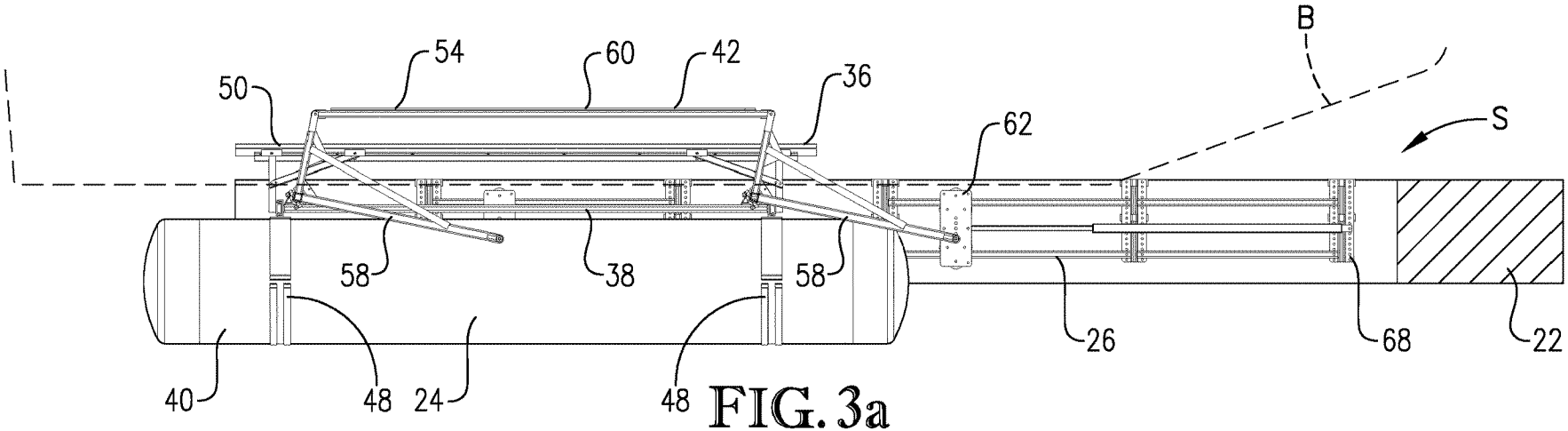
FIG. 3*a* is a fragmentary side elevation of the boat lift assembly and floating dock shown in FIGS. 1 and 2, showing the boat lift and the carriage assembly in the extended position, with a boat being supported on a platform of the boat lift and depicted schematically.
Figure 3B:
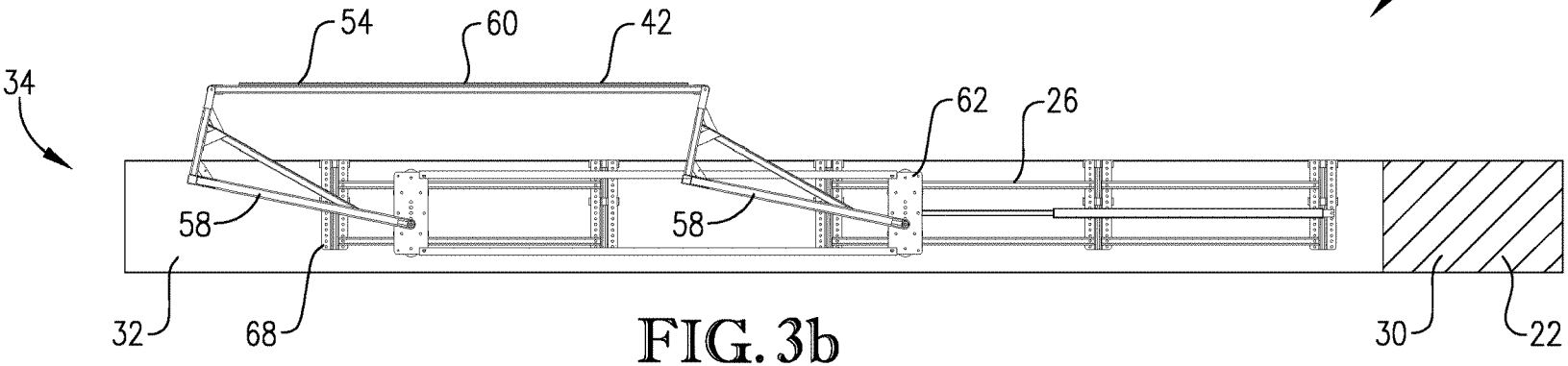
FIG. 3*b* is a fragmentary side elevation of the boat lift assembly and floating dock similar to FIG. 3*a*, but showing pontoons and a lift frame of the boat lift removed to depict a lift linkage assembly of the boat lift attached to a carriage of the carriage assembly.
Figure 4:
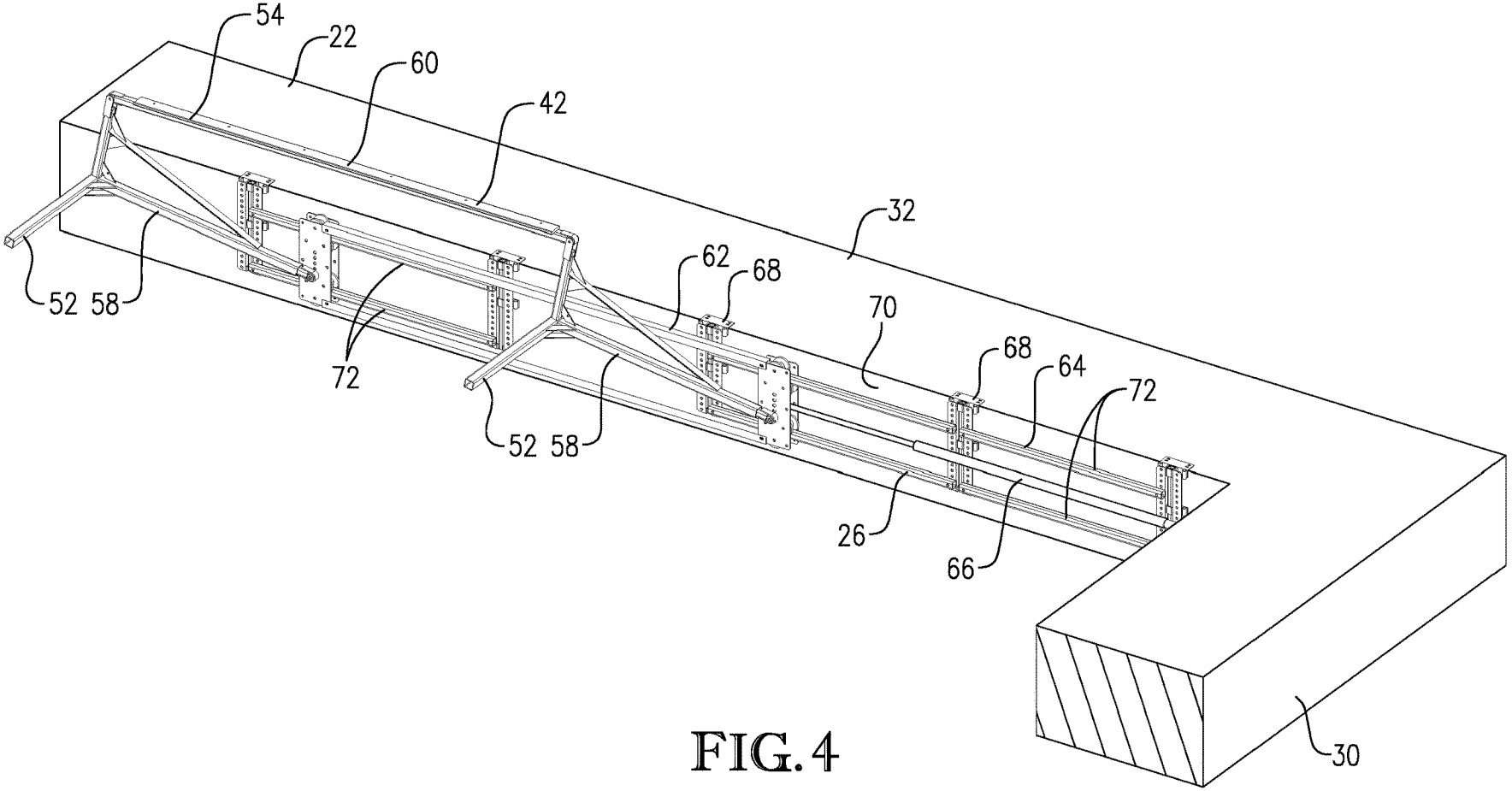
FIG. 4 is a fragmentary upper perspective view of the boat lift assembly shown in FIGS. 1-3*b;*

While the drawings do not necessarily provide exact dimensions or tolerances for the illustrated components or structures, the drawings are to scale with respect to the relationships between the components of the structures illustrated in the drawings.

DETAILED DESCRIPTION OF THE PREFERRED EMBODIMENT

Turning initially to FIGS. 1-3*b*, a boat lift assembly 20 is configured to selectively support and store a boat B (see FIG. 3*a*) adjacent a dock 22. In the usual manner, boat lift assembly 20 is configured to raise and lower the boat B relative to a storage position by adjusting the buoyancy of pontoons. However, the depicted boat lift assembly 20 also may be extended and retracted relative to a berth (or slip) S defined at least partly by the dock 22. In this manner, the boat lift assembly 20 preferably permits relative horizontal shifting of the supported boat B into and out of the berth S. As will be explained, horizontal shifting of the boat B permits the dock 22 and boat lift assembly 20 to accommodate a boat B that is longer than the length of the berth S.

Boat lift assembly 20 broadly includes a boat lift 24 and a carriage assembly 26. As described below, the carriage assembly 26 shiftably interconnects the dock 22 and the boat lift 24 and includes a pair of shiftable carriages that permit longitudinal shifting of the boat lift 24.

Figure 5:
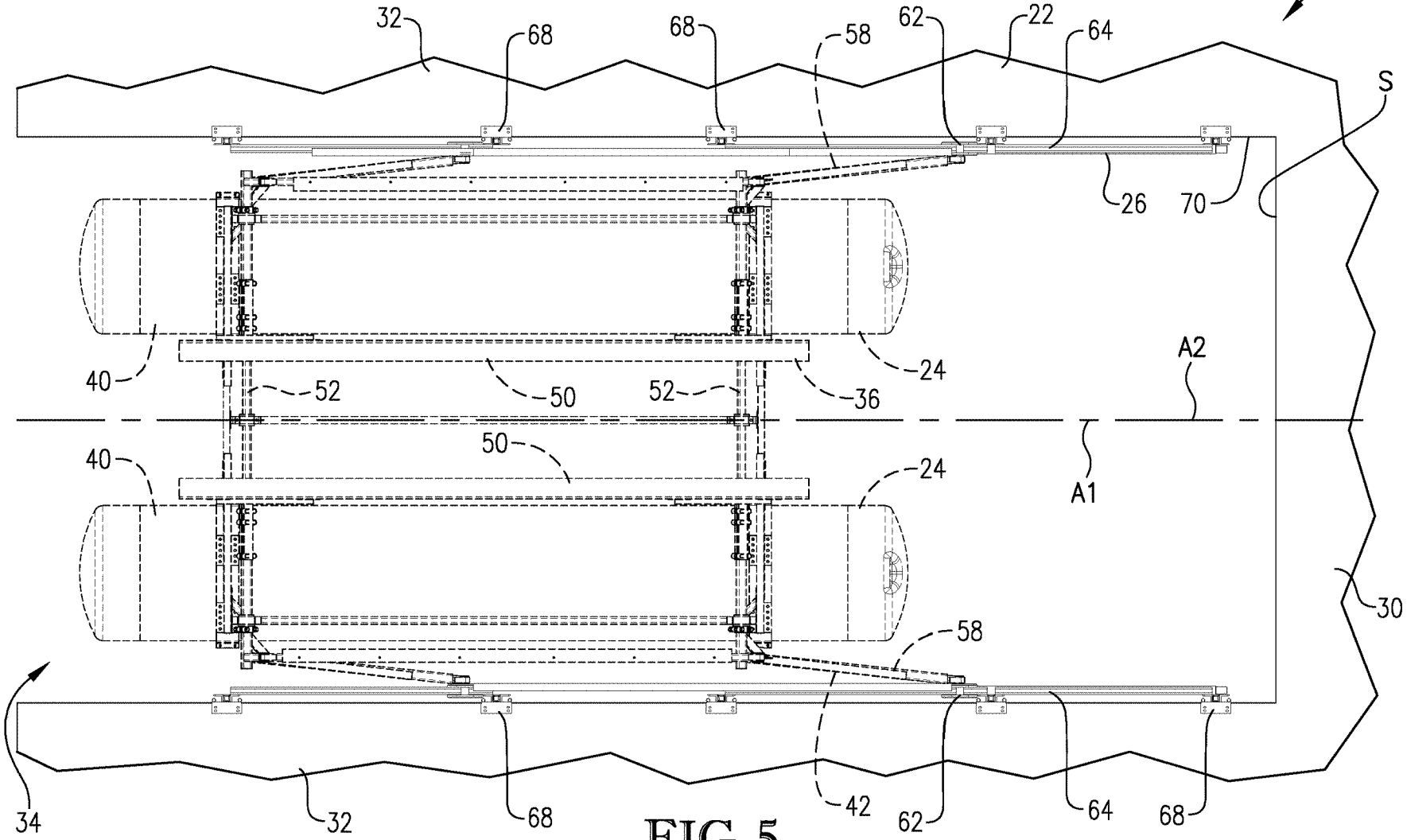
FIG. 5 is a top view of the boat lift assembly shown in FIGS. 1-4, showing the boat lift assembly in a retracted position.
Figure 6A:
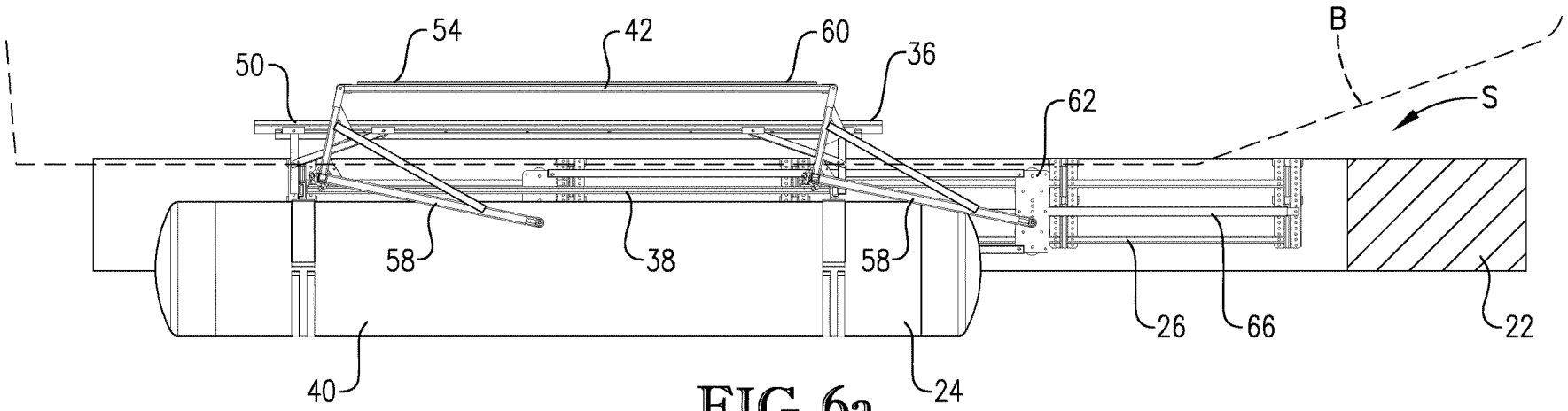
FIG. 6*a* is a fragmentary side elevation of the boat lift assembly and floating dock similar to FIG. 3*a*, but showing the boat lift assembly in the retracted position.
Figure 6B:
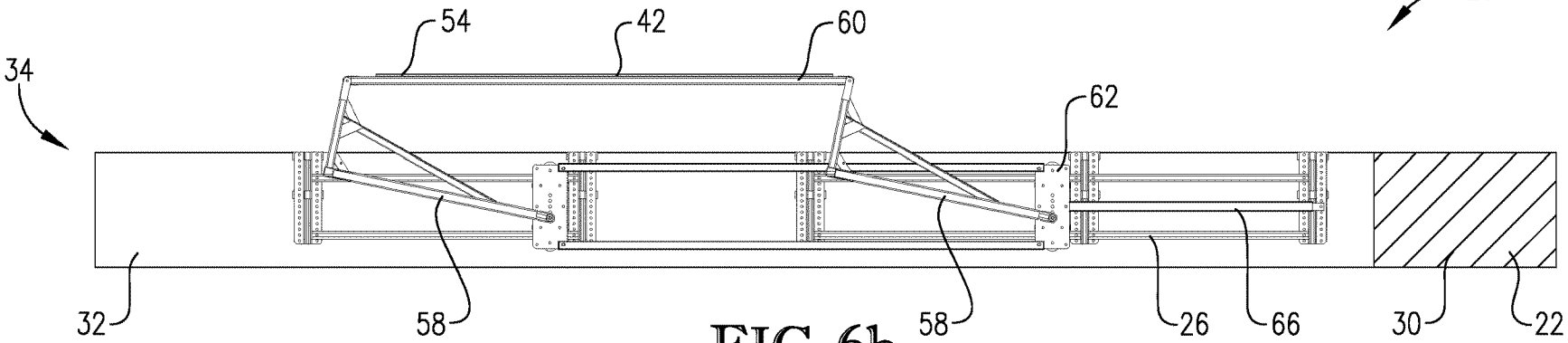
FIG. 6*b* is a fragmentary side elevation of the boat lift assembly and floating dock similar to FIG. 3*b*, but showing the boat lift assembly in the retracted position.
Figure 7:
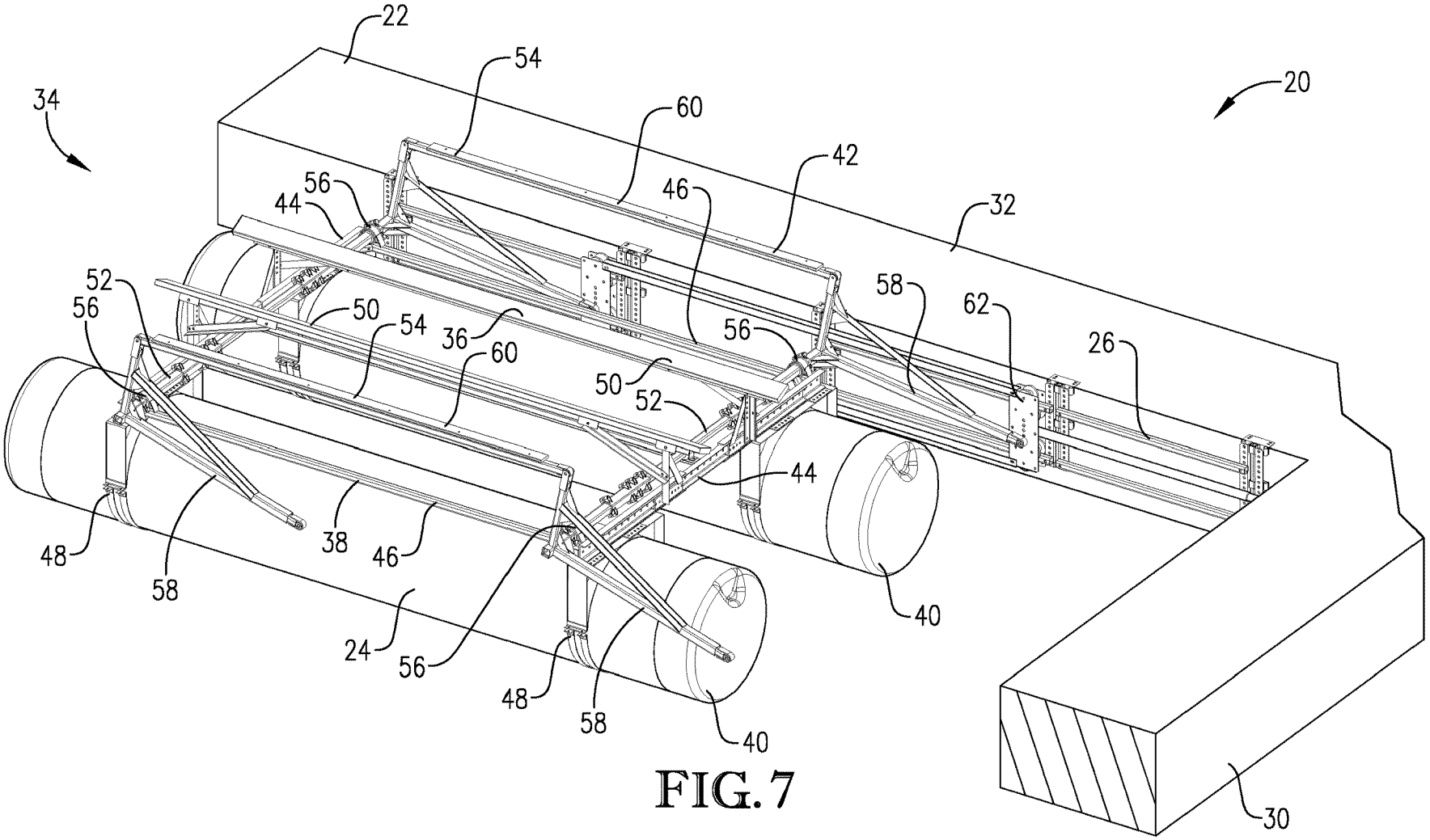
FIG. 7 is a fragmentary upper perspective view of the boat lift assembly similar to FIG. 4, but showing the boat lift assembly in the retracted position.
Figure 8:
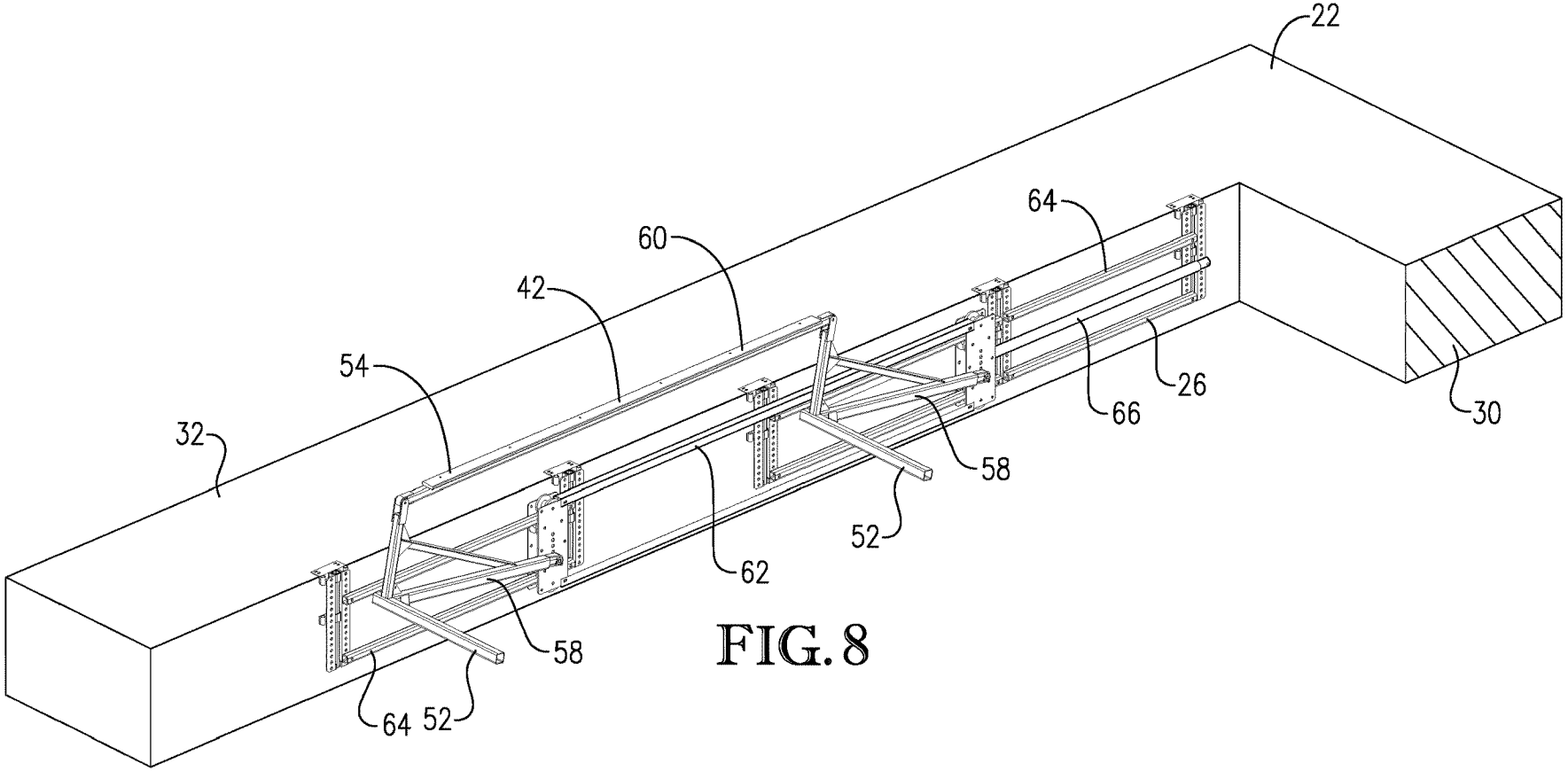
FIG. 8 is a fragmentary upper perspective view of the boat lift assembly shown in FIGS. 1-7.
Figure 9:
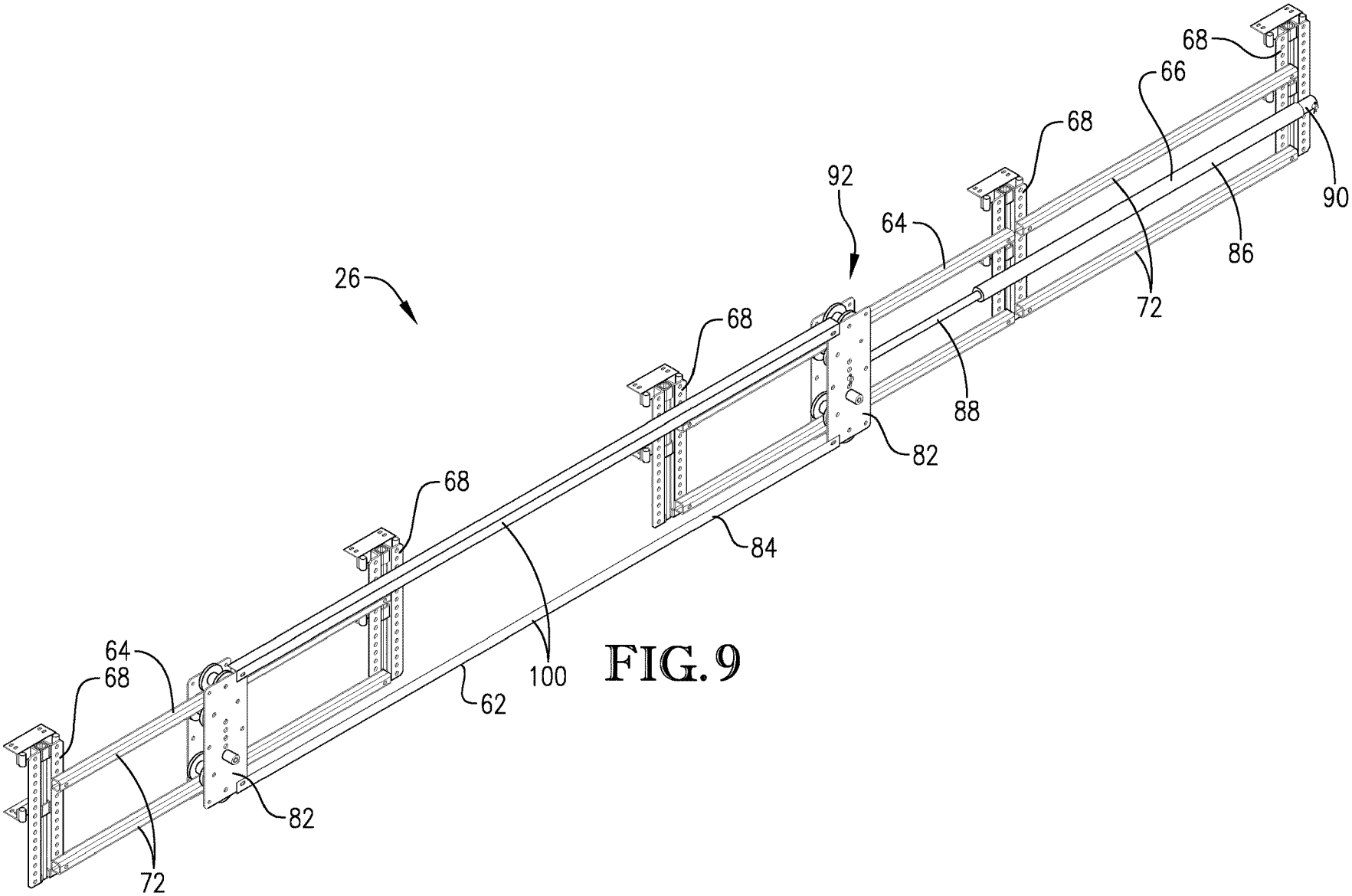
FIG. 9 is an upper perspective view of the carriage assembly shown in FIGS. 1-8, showing a shiftable carriage slidably mounted on a respective carriage track, and with the carriage including a pair of beam trolleys.
Figure 10:
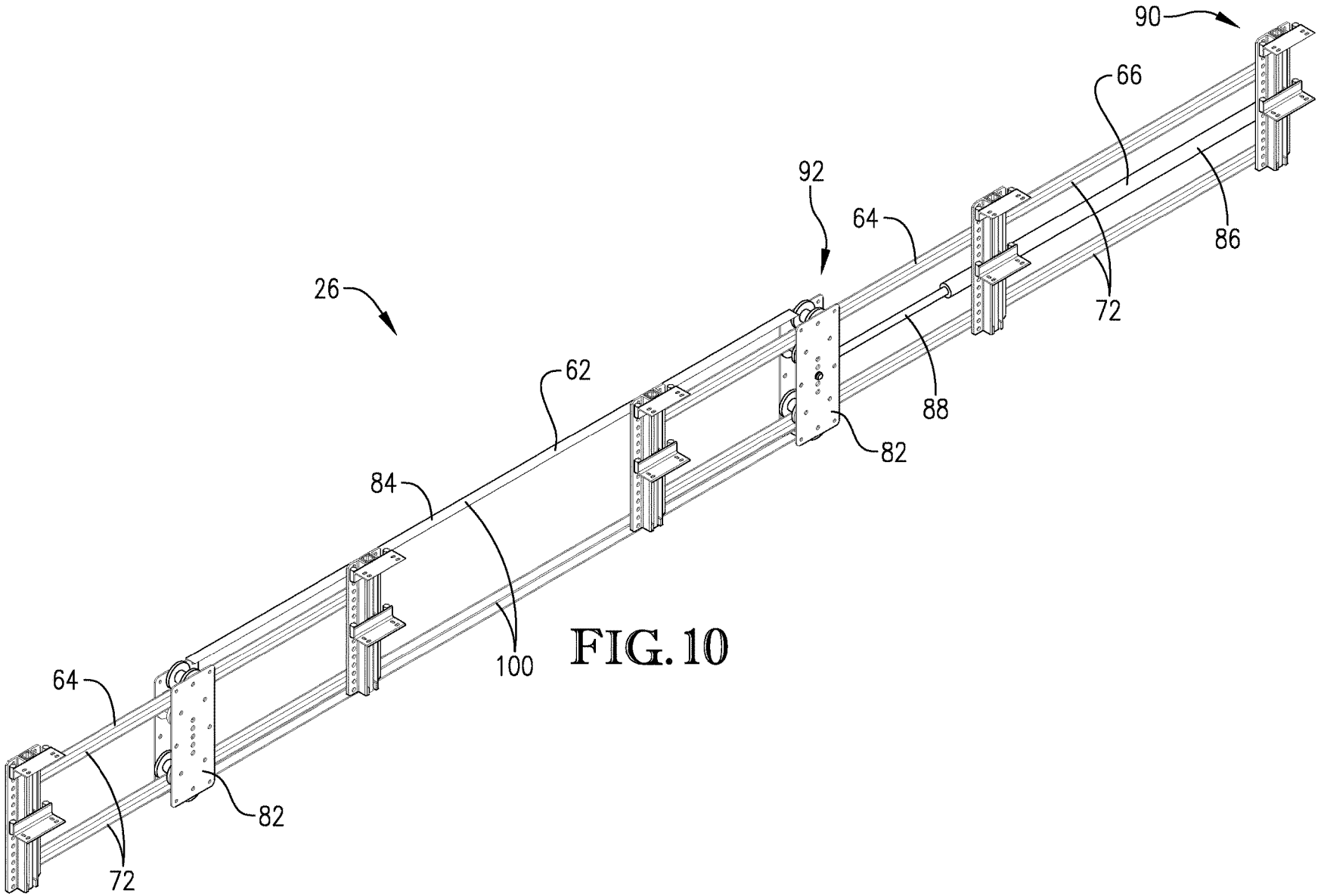
FIG. 10 is an upper perspective view of the carriage assembly similar to FIG. 9, but shown from the opposite side.
Figure 11:
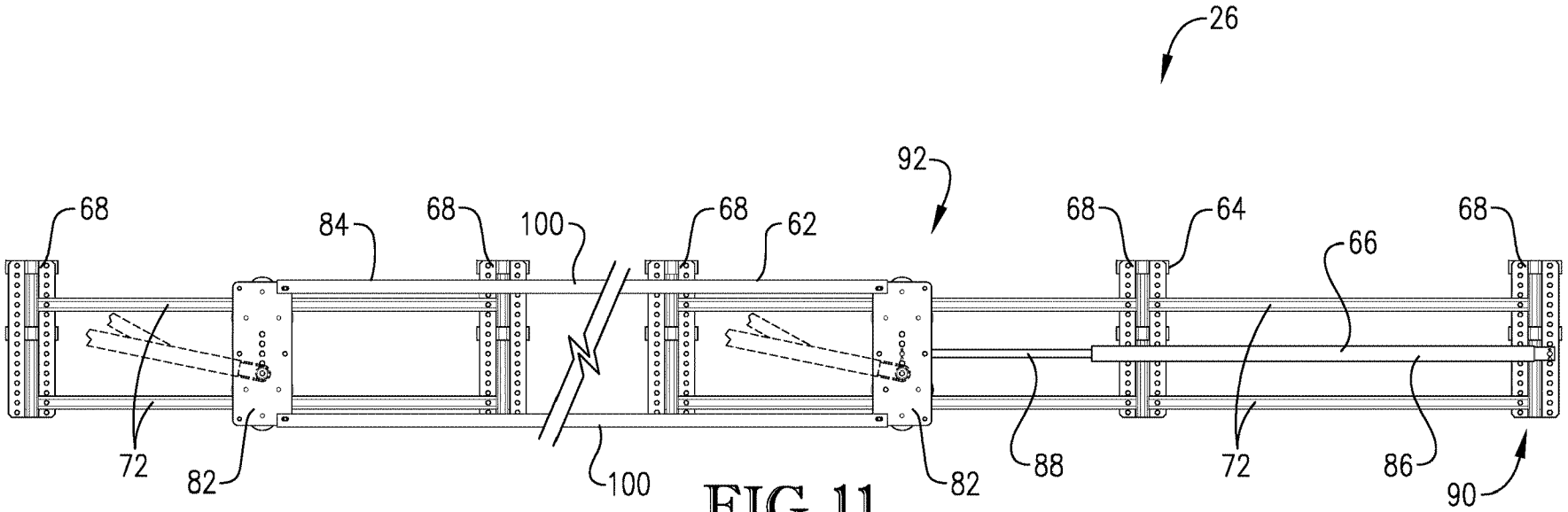
FIG. 11 is a side elevation of the carriage assembly shown in FIGS. 1-10.
Figure 12:
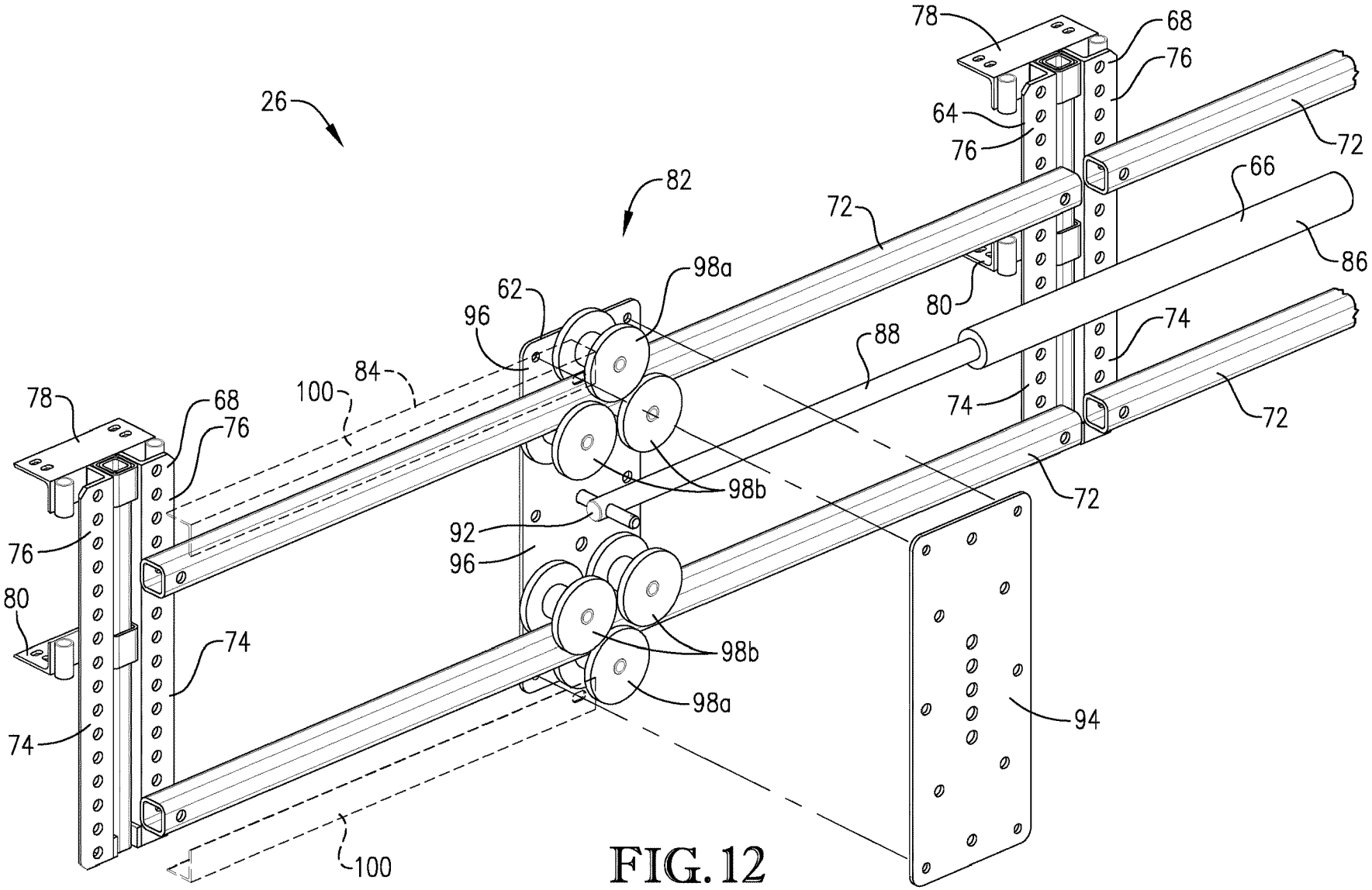
FIG. 12 is an enlarged fragmentary perspective view of the carriage assembly shown in FIGS. 1-11, showing one of the beam trolleys partly exploded to depict sheaves mounted between trolley brackets.

In the depicted embodiment, dock 22 preferably comprises a floating dock that includes dock float elements and decking supported on top of the dock float elements. Dock 22 also defines an end section 30 and a pair of opposite piers 32 attached to the end section to cooperatively form the berth S. The dock 22 further presents an open end 34 that permits boat ingress and egress movement along a longitudinal dock axis A1 (see FIG. 5). In the usual manner, the boat B is at least partly received within the berth S when supported by the boat lift assembly 20.

It is also consistent with the scope of the present invention for embodiments of the boat lift assembly to be used with an alternative dock structure. For instance, the boat lift assembly may be operably associated with a fixed dock or a fixed pier. It will also be appreciated that a suitable dock may include fixed and floating elements.

Turning to FIGS. 1-8, boat lift 24 comprises a floating boat lift device that provides a vertically-shiftable platform to shift the boat B vertically between a raised storage position (see FIGS. 1-4) and a lowered position (not shown). Boat lift 24 defines a longitudinal lift axis A2 that is generally parallel to the dock axis A1 (see FIG. 5).

Boat lift 24 preferably includes a platform 36, lift frame 38, pontoons 40, and a lift linkage assembly 42. The lift frame 38 includes spaced cross members 44 and longitudinal members 46 that are attached to the pontoons 40 via clamps 48 (see FIGS. 1 and 7). Platform 36 is formed by a pair of longitudinal supports 50 centrally fixed above the lift frame 38.

In the usual manner, pontoons 40 provide the boat lift 24 with adjustable buoyancy and have a conventional construction. Pontoons 40 are longitudinally arranged and spaced on opposite sides of the lift axis A2. It is also within the scope of the present invention for the boat lift to include an alternative configuration of pontoons or other float structures to provide the boat lift with suitable buoyancy.

Still referring to FIGS. 1-8, linkage assembly 42 shiftably interconnects the platform 36 and the carriage assembly 26 to permit vertical shifting of the platform 36 relative to the carriage and the dock 22. In the depicted embodiment, linkage assembly 42 preferably includes a pair of torsion bars 52 and opposite linkages 54 that are operably connected to one another by the torsion bars 52.

Torsion bars 52 comprise elongated tube members that are positioned adjacent to longitudinal ends of the lift frame 38 and extend laterally from one side of the lift frame 38 to the other side thereof. Torsion bars 52 are rotatably supported by mounts 56 (see FIG. 7), which are fixed to the lift frame 38, and which receive elastomeric inserts. Additional details of a preferred boat lift having a linkage with torsion bars is disclosed in U.S. Pat. No. 5,131,784, which is hereby incorporated in its entirety by reference herein.

Each linkage 54 preferably serves to operably interconnect the torsion bars 52 and includes a pair of pivot arms 58 and a cross link 60 that connects the pivot arms 58. In the depicted embodiment, the linkages 54 are preferably located on opposite sides of the platform 36.

The pivot arms 58 and cross link 60 cooperatively define a four-bar linkage that attaches the boat lift 24 relative to the dock 22 and facilitates uniform up-and-down vertical movement of the platform 36 relative to the dock 22. In particular, the pivot arms 58 of each linkage 54 cooperatively pivot as the platform 36 moves vertically relative to the dock 22 and the respective carriage. As will be discussed, the pivot arms 58 are pivotally attached relative to beam trolleys of the respective carriage.

However, for at least certain aspects of the present invention, embodiments of the boat lift may include an alternative linkage assembly that attaches the boat lift relative to the dock and permits vertical platform movement.

The linkage assembly 42 preferably facilitates movement of the boat lift 24 between the raised storage position (see FIGS. 1-4) and the lowered position (not shown). In the lowered position, the boat lift 24 permits advancement of the boat B onto the platform 36 or off of the platform 36 while the boat B is floating on the water. When the boat B is located on the platform 36 in the raised position, the boat lift 24 elevates the boat B out of the water and restricts the boat B from being moved off of the platform 36.

Preferably, the boat lift 24 is shiftable between the raised and lowered positions when the boat lift 24 is extended relative to the berth S. For instance, the boat lift 24 is preferably lowered while the boat lift 24 is extended to permit convenient movement of the boat B onto or off of the platform 36.

By locating the platform 36 in the extended position and thereby maximizing the space between the platform 36 and the end section 30 of the dock 22, those of skill in the art will understand that the boat lift position minimizes the potential for inadvertent contact between the boat B and the dock 22, particularly the end section 30.

However, for at least certain aspects of the present invention, it will be appreciated that the boat lift 24 is shiftable between the raised and lowered positions while the boat lift 24 is in a retracted position.

Turning to FIGS. 2-12, the carriage assembly 26 shiftably interconnects the dock 22 and the boat lift 24 and facilitates longitudinal shifting of the boat lift 24 relative to the berth S between an extended position (see FIGS. 1-4) and a retracted position (see FIGS. 5-8). Carriage assembly 26 may be provided as part of a boat lift system that is newly installed at a dock. However, it will be appreciated that the carriage assembly 26 may also be provided as part of a boat lift kit that is installed as an aftermarket accessory for an existing boat lift (such as the boat lift 24).

As noted above, the illustrated carriage assembly 26 includes a pair of shiftable carriages 62 that permit longitudinal shifting of the boat lift 24. Carriage assembly 26 also preferably includes opposite carriage tracks 64, for supporting the carriages 62, and a drive assembly 66 configured to shift the carriages 62 along the length of the carriage tracks 64.

The elongated carriage tracks 64 are operable to be attached relative to the dock 22 and extend horizontally along the length of the berth S. In the depicted embodiment, each carriage track 64 includes brackets 68 spaced along an inner margin 70 of the dock 22 and a pair of track rails 72 attached to the brackets 68 (see FIGS. 4 and 9-11).

Each bracket 68 comprises a pair of upright angle members 74 with attachment flanges 76 (see FIG. 12) that present a front-facing attachment interface for adjustably mounting the track rails 72 with fasteners (not shown). Upper and lower bracket mounting flanges 78,80 are fixed to the upright angle members in a rear-facing orientation for mounting the bracket 68 along the inner margin 70 of the dock 22 (see FIG. 12).

Although the illustrated bracket configuration is preferred, alternative embodiments of the carriage assembly may include one or more alternative brackets for mounting the track rails. For at least certain aspects of the present invention, embodiments of the carriage track may include a track rail that is mounted directly to a dock or pier structure without the use of a bracket.

The track rails 72 cooperatively guide the carriage 62 along the longitudinal dock axis A1 for boat lift ingress and egress relative to the berth S. Track rails 72 each comprise an elongated tubular structure. In the depicted embodiment, each track rail 72 has a cross-sectional profile that is generally square with rounded corners. In alternative embodiments, one or more track rails may have an alternative shaped tubular profile shape, such as a circle, oval, triangle, rectangle, or another polygonal shape. It is also within the scope of the present invention for one or more track rails to have a non-tubular beam profile shape, such as an I-shape, T-shape, or an L-shape beam.

A pair of track rails 72 are preferably mounted to extend generally parallel to one another. For at least certain aspects of the present invention, the carriage track 64 may include more than two (2) track rails or may comprise a single track rail.

Carriages 62 are each operably attached to the boat lift 24 for longitudinal shifting of the boat lift 24 between the extended position (see FIGS. 1-4) and the retracted position (see FIGS. 5-8). Preferably, the carriage 62 is slidably supported at least in part by a respective carriage track 64 to slide along the length thereof and shift the boat lift 24 and boat B horizontally relative to the berth S. However, for at least certain aspects of the present invention, an alternative carriage assembly could have a single carriage.

Turning to FIGS. 9-12, each carriage 62 includes a plurality of beam trolleys 82 slidably mounted on the carriage track 64 and a carriage frame 84 that interconnects the beam trolleys 82. The beam trolleys 82 cooperatively guide the boat lift 24 as the carriage 62 slides along the length of the carriage track 64. For at least certain aspects of the present invention, an alternative carriage embodiment may include more than two (2) beam trolleys or a single beam trolley.

Preferably, the boat lift 24 is shiftable between the extended and retracted positions while the boat lift 24 is in the raised position. For instance, the boat lift 24 is preferably extended and retracted while the boat lift 24 is raised to permit convenient movement of the boat B into and out of the berth S for storage.

By locating the platform 36 in the raised position, those of skill in the art will understand that the boat lift position minimizes the potential for inadvertent contact between the boat B and the dock 22, particularly the end section 30, as the boat B and boat lift 24 are advanced into the retracted position. This system and method for storing the boat B also facilitates storage of a boat B that is longer than the length of the berth S.

However, for at least certain aspects of the present invention, it will be appreciated that the boat lift 24 may be shiftable between the extended and retracted positions while the boat lift 24 is in the lowered position.

Each carriage 62 is preferably associated with a drive assembly 66 that comprises a motor capable of imparting motion to shift the carriage 62 along the length of the carriage track 64. The drive assembly 66 is operably supported relative to the carriage track 64 and attached relative to the carriage 62.

In the depicted embodiment, drive assembly 66 preferably comprises a hydraulic cylinder with a cylinder body 86 and a piston 88 that slides into and out of the body 86 between a retracted condition and an extended condition. A proximal end 90 of the cylinder body 86 is attached to a bracket 68, while a distal end 92 of the piston 88 is attached to a beam trolley 82 of the carriage 62. In the usual manner, the drive assembly 66 is also preferably associated with a hydraulic sump (not shown) for holding hydraulic fluid and a powered hydraulic pump (not shown) for powering the drive assembly 66 with pressurized hydraulic fluid. It will be understood that a single pump may be used to power both drive assemblies 66.

Although the use of a hydraulic cylinder is preferred, alternative embodiments of the carriage assembly may include an alternative drive assembly, such as a pneumatic motor or an electrical motor. It will also be appreciated that one or more alternative motors may comprise a linear motor (e.g., a pneumatic or electrical linear motor) or a rotating motor (e.g., a pneumatic, electrical, or hydraulic motor).

Furthermore, alternative embodiments of a drive assembly may be accompanied by a transmission that is drivingly powered by a motor and is configured to transmit power from the motor to the carriage assembly. For instance, alternative embodiments may include a gear transmission, a chain-and-sprocket drive, a belt-and-pulley drive, and/or other transmission elements.

As the piston 88 is shifted toward the extended condition, the drive assembly 66 causes corresponding longitudinal movement of the carriage 62 toward the extended position. Conversely, as the piston 88 is shifted toward the retracted condition, the drive assembly 66 causes corresponding longitudinal movement of the carriage 62 toward the retracted position.

The illustrated carriage assembly 26 preferably includes a pair of drive assemblies 66 associated with respective carriages 62 and mounted on opposite sides of the berth S. However, it is also within the ambit of the present invention for the carriage assembly to include more than two (2) drive assemblies or to include a single drive assembly. For instance, an alternative carriage assembly may have a single hydraulic cylinder that is centrally mounted at the head of the berth and spaced from opposite sides of the berth to apply an extension force or a retraction force along the lift axis A2. Yet further, for at least certain aspects of the present invention, the boat lift assembly may be devoid of any motors for shifting the boat lift between the retracted position and the extended position.

The illustrated beam trolleys 82 are configured to operably engage a respective carriage track 64 and are spaced along the carriage track 64. Each beam trolley 82 preferably includes inner and outer trolley brackets 94,96 and sheaves 98 rotatably supported between the trolley brackets 94,96 (see FIG. 12). As described below, sheaves 98 comprise a preferred shiftable bearing element that is configured to engage the carriage track 64.

Although beam trolleys preferably include sheaves to shiftably engage the carriage track, alternative embodiments may include an alternative shiftable bearing element to engage the track. For instance, alternative bearing elements may include an alternative rotatable wheel structure configured to be in rolling engagement with the carriage track. Yet further, alternative embodiments may include a bearing element that slides along the carriage track without spinning (e.g., a plain bearing or sliding bearing).

Preferably, the beam trolley 82 includes a pair of outboard sheaves 98*a* and two pairs of inboard sheaves 98*b*. The outboard sheaves 98*a* are located along a respective side of the carriage track 64. In particular, the outboard sheaves 98*a* are located outboard of and in rolling engagement with a corresponding track rail 72.

It is also within the scope of at least certain aspects of the present invention for an alternative beam trolley to include more than one outboard sheave in rolling engagement with a respective track rail. For certain aspects of the present invention, an alternative beam trolley may be devoid of any outboard sheave in engagement with at least one of the track rails.

Each pair of inboard sheaves 98*b* is located inboard of and is in rolling engagement with a corresponding track rail 72. Each pair of inboard sheaves 98*b* and the respective outboard sheave 98*a* cooperatively engage the respective track rail 72 to restrict off-axis movement of the beam trolley 82 relative to the track rail 72.

It is also within the scope of at least certain aspects of the present invention for an alternative beam trolley to include a single inboard sheave or more than two (2) inboard sheaves in rolling engagement with a respective track rail. For certain aspects of the present invention, an alternative beam trolley may be devoid of any inboard sheave in engagement with at least one of the track rails.

In the illustrated embodiment, the beam trolleys 82 are interconnected by a carriage frame 84 that includes cross members 100. Cross members 100 preferably comprise elongated angle members that are attached to the trolley brackets 94,96 with fasteners (not shown).

The cross members 100 and trolley brackets 94,96 cooperatively define a rigid framework to support the linkage 54. More specifically, the pivot arms 58 are pivotally attached to and supported by respective trolley brackets 94,96.

As the carriage 62 is advanced along the longitudinal dock axis A1, the sheaves 98 of each beam trolley 82 are in rolling engagement with the carriage track 64. However, it will be appreciated that one or more of the sheaves may not be in continuous engagement with the carriage track during operation. For instance, one or more beam trolleys may be configured so that at least some "play" exists between the sheaves and at least one of the track beams, such that a respective sheave may periodically move into and/or out of rolling engagement with the track beam.

Carriage assembly 26 may be provided as part of a boat lift system that is newly installed at a dock. However, it will be appreciated that the carriage assembly 26 may also be provided as part of a boat lift kit that is installed as an aftermarket accessory for an existing boat lift (such as the boat lift 24).

In operation, the boat B may be selectively moved by the boat lift 24 into a storage position. the boat lift 24 is shiftable into and out of a lowered position so that a floating boat may be positioned onto the platform 36. Preferably, the boat lift 24 is in the extended position to receive the boat onto the platform 36 although, in at least certain instances, the boat lift 24 may be retracted when receiving the boat.

With the boat positioned above the platform 36, the boat lift 24 may be elevated from the lowered position to the raised position to engage the boat B with the platform 36 and lift the boat B out of the water. The boat lift 24 and boat B may then be shifted from the extended position to the retracted position by simultaneously retracting the pistons 88 of the motors 66. This retraction of the boat lift 24 moves the boat B farther into the berth S for storage. Advantageously, this process also facilitates storage of a boat B that is longer than the length of the berth S.

The boat B may be selectively moved by the boat lift 24 out of the storage position. For instance, where the boat lift 24 is raised and retracted, the boat lift 24 may be shifted longitudinally to the extended position so as to move the boat B away from the end section 30. With the boat lift 24 extended, the boat lift 24 may be lowered from the raised position to the lowered position so that the platform 36 is disengaged from the boat B and the boat B is floating on the water. The operator may then advance the floating boat B away from the platform 36.

For at least certain instances, it will be appreciated that the boat lift 24 and boat B may be lowered into the lowered position while the boat lift 24 is retracted. This may be suitable for smaller vessels where contact between the boat B and the dock 22 is easily avoided when the boat lift 24 is retracted and lowered.

As used herein, the phrase "and/or," when used in a list of two or more items, means that any one of the listed items can be employed by itself or any combination of two or more of the listed items can be employed. For example, if a composition is described as containing or excluding components A, B, and/or C, the composition can contain or exclude A alone; B alone; C alone; A and B in combination; A and C in combination; B and C in combination; or A, B, and C in combination.

The present description uses numerical ranges to quantify certain parameters relating to various embodiments of the invention. It should be understood that when numerical ranges are provided, such ranges are to be construed as providing literal support for claim limitations that only recite the lower value of the range as well as claim limitations that only recite the upper value of the range. For example, a disclosed numerical range of about 10 to about 100 provides literal support for a claim reciting "greater than about 10" (with no upper bounds) and a claim reciting "less than about 100" (with no lower bounds).

As used herein, the term "includes" may refer to an item that includes something as a part thereof or is entirely made up of that something.

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

We claim:

1. A boat lift assembly configured to support a boat adjacent a dock and permit relative horizontal shifting of the supported boat into and out of a berth defined at least partly by the dock, said boat lift assembly comprising:

a boat lift including a vertically-shiftable platform to support and position the boat;

an elongated carriage track configured to be attached relative to the dock and extend horizontally along the length of the berth; and a shiftable carriage operably attached to the boat lift, said carriage being slidably supported at least in part by the carriage track to slide along the length thereof and shift the boat lift and boat horizontally relative to the berth, said boat lift including a linkage shiftably interconnecting the platform and the carriage to permit vertical shifting of the platform relative to the carriage, said carriage including a beam trolley slidably supported on the carriage track, with the beam trolley guiding the boat lift as the carriage slides along the length of the carriage track, said linkage including a set of pivot arms pivotally attached relative to the beam trolley, with the set of pivot arms cooperatively pivoting as the platform moves vertically relative to the carriage.

2. The boat lift assembly as claimed in claim 1, said carriage including a beam trolley slidably supported on the carriage track, with the beam trolley guiding the boat lift as the carriage slides along the length of the carriage track.

3. The boat lift assembly as claimed in claim 2, said carriage including another beam trolley slidably supported on the carriage track, with the beam trolleys cooperatively guiding the boat lift as the carriage slides along the length of the carriage track.

4. The boat lift assembly as claimed in claim 3, said beam trolleys being spaced along the carriage track, said carriage including a carriage frame that interconnects the beam trolleys.

5. The boat lift assembly as claimed in claim 2, said beam trolley including a pair of sheaves, with each sheave located along a respective side of the track.

6. The boat lift assembly as claimed in claim 2, further comprising:

another shiftable carriage operably attached to the boat lift and including another beam trolley, with the carriages being located on opposite sides of the platform.

7. The boat lift assembly as claimed in claim 6, said another carriage including another beam trolley, with the beam trolleys cooperatively guiding the boat lift as the carriage slides along the length of the carriage track.

8. The boat lift assembly as claimed in claim 2, said carriage track including a pair of track rails that extend generally parallel to one another, said beam trolley including a plurality of sheaves, with each of the track rails being captured between a respective pair of said sheaves.

9. The boat lift assembly as claimed in claim 1, further comprising:

a drive assembly operably supported relative to the carriage track and attached relative to the carriage, with the drive assembly being configured to shift the carriage along the length of the carriage track.

10. The boat lift assembly as claimed in claim 9, said drive assembly comprising a hydraulic cylinder.

11. The boat lift assembly as claimed in claim 1, further comprising:

another shiftable carriage operably attached to the boat lift and including another beam trolley, with the carriages being located on opposite sides of the platform, said boat lift including another linkage shiftably interconnecting the platform and the another carriage, with the linkages being located on opposite sides of the platform.

12. The boat lift assembly as claimed in claim 11, said another linkage including another set of pivot arms pivotally attached relative to the another beam trolley, with the another set of pivot arms cooperatively pivoting as the platform moves vertically relative to the carriage.

13. The boat lift assembly as claimed in claim 1, said boat lift including one or more buoyant pontoons so that the boat lift comprises a floating boat lift.

14. A boat lift kit operable to be installed as part of a boat lift assembly that is configured to support a boat adjacent a dock and permit relative horizontal shifting of the supported boat into and out of a berth defined at least partly by the dock, said boat lift assembly including a boat lift with a vertically-shiftable platform to support and position the boat, said boat lift kit comprising:

an elongated carriage track configured to be attached relative to the dock and extend horizontally along the length of the berth; and a shiftable carriage configured to be operably attached to the boat lift, said carriage being slidably supported at least in part by the carriage track to slide along the length thereof and shift the boat lift and boat horizontally relative to the berth, said carriage including a plurality of beam trolleys slidably supported on the carriage track, with the beam trolleys cooperatively guiding the boat lift as the carriage slides along the length of the carriage track, said boat lift including a linkage shiftably interconnecting the platform and the carriage to permit vertical shifting of the platform relative to the carriage, said carriage including a beam trolley slidably supported on the carriage track, with the beam trolley guiding the boat lift as the carriage slides along the length of the carriage track, said linkage including a set of pivot arms pivotally attached relative to the beam trolley, with the set of pivot arms cooperatively pivoting as the platform moves vertically relative to the carriage.

15. The boat lift kit as claimed in claim 14, said carriage including another beam trolley slidably supported on the carriage track, with the beam trolleys cooperatively guiding the boat lift as the carriage slides along the length of the carriage track.

16. The boat lift kit as claimed in claim 15, said beam trolleys being spaced along the carriage track, said carriage including a carriage frame that interconnects the beam trolleys.

17. The boat lift kit as claimed in claim 14, said beam trolley including a pair of sheaves, with each sheave located along a respective side of the track.

18. The boat lift kit as claimed in claim 14, further comprising:

another shiftable carriage operably attached to the boat lift and including another beam trolley, with the carriages being located on opposite sides of the platform.

19. The boat lift kit as claimed in claim 18, said another carriage including another beam trolley, with the beam trolleys cooperatively guiding the boat lift as the carriage slides along the length of the carriage track.

20. The boat lift kit as claimed in claim 14, said carriage track including a pair of track rails that extend generally parallel to one another, said beam trolley including a plurality of sheaves, with each of the track rails being captured between a respective pair of said sheaves.

21. The boat lift kit as claimed in claim 14, further comprising:

a drive assembly operably supported relative to the carriage track and attached relative to the carriage, with the drive assembly being configured to shift the carriage along the length of the carriage track.

22. The boat lift kit as claimed in claim 21, said drive assembly comprising a hydraulic cylinder.

23. A method of retrofitting a boat lift with a carriage assembly that permits relative horizontal shifting of a supported boat into and out of a berth defined at least partly by a dock, said method comprising the steps of:

attaching an elongated carriage track of the carriage assembly relative to the dock, with the carriage track extending horizontally along the length of the berth;

attaching a carriage of the carriage assembly to the boat lift; and shiftably mounting the carriage to the carriage track so that the carriage assembly may be operated to guide the boat lift along the length of the carriage track, said carriage including a beam trolley slidably supported on the carriage track, with the beam trolley guiding the boatlift as the carriage slides along the length of the carriage track, said boat lift including a linkage shiftably interconnecting the platform and the carriage to permit vertical shifting of the platform relative to the carriage, said linkage including a set of pivot arms pivotally attached relative to the beam trolley with the set of pivot arms cooperatively pivoting as the platform moves vertically relative to the carriage.

* * * * *